US007802387B1

(12) United States Patent
Siebuhr

(10) Patent No.: US 7,802,387 B1
(45) Date of Patent: Sep. 28, 2010

(54) STORE INFORMATION MOUNT APPARATUS

(75) Inventor: Aaron Siebuhr, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 12/408,387

(22) Filed: Mar. 20, 2009

(51) Int. Cl.
*B42F 17/20* (2006.01)

(52) U.S. Cl. ..... 40/376; 281/4

(58) Field of Classification Search ..... 40/376, 40/389, 388, 390, 404, 533, 536; 281/3.1, 281/15.1, 43, 44, 45
See application file for complete search history.

(56) References Cited

U.S. PATENT DOCUMENTS 1,296,304 A * 3/1919 Marx ..... 40/120
4,139,216 A * 2/1979 Saint Clair ..... 281/4
4,179,138 A * 12/1979 Bogdanovic ..... 281/44
4,369,948 A * 1/1983 Krauss et al. ..... 248/444.1
4,666,409 A * 5/1987 Sandberg ..... 434/365
4,827,641 A * 5/1989 Mori ..... 40/376
4,982,683 A * 1/1991 Earnest, Jr. ..... 116/63 P
5,819,456 A * 10/1998 Schwartz ..... 40/642.01
5,829,176 A * 11/1998 Gruneisen, III ..... 40/376
6,434,871 B2 * 8/2002 Conway ..... 40/651
6,843,505 B1 * 1/2005 Eriksen ..... 281/3.1
7,124,988 B1 * 10/2006 Duffy et al. ..... 248/284.1
7,281,344 B2 * 10/2007 Knauf ..... 40/649

* cited by examiner

*Primary Examiner*—Lesley Morris
*Assistant Examiner*—Shin Kim
(74) *Attorney, Agent, or Firm*—John L. Rogitz

(57) ABSTRACT

A store information mount apparatus for flippably displaying substrates bearing information pertaining to a consumer electronic device. The apparatus has amount flange, a display flange made integrally with the store mount flange, a clamp flange bearing plural ring clamps to be received by the display flange, and at least one substrate engaged with the ring clamps.

17 Claims, 4 Drawing Sheets

STORE INFORMATION MOUNT APPARATUS

FIELD OF THE INVENTION

The present invention relates generally to store information mount apparatus.

BACKGROUND OF THE INVENTION

In-store displays of electronic devices sold by consumer electronic retail stores are typically provided so that consumers may inspect a particular model prior to purchasing one. Moreover, some of these consumer electronic device retailers offer various appearance options for the device casing such as color. Retail stores often provide multiple samples of the same device model with the different device options so that a consumer may see first hand the options that are available.

These displays, which may consist of multiple identical devices with different device colors, take up a relatively significant amount of space in a retail store. Such large displays may also increase the store's overhead costs because multiple devices, all of the same model, must be allocated to in-store displays rather than kept available as sellable inventory. Even further, this cost repeats itself every time a manufacturer releases a new device model which the retail store then displays.

SUMMARY OF THE INVENTION

A store information mount apparatus for flippably displaying plural substrates includes a store mount flange formed with at least one hole so that a fastener can extend through the hole and into a store mount to engage the store mount flange with the store mount. A display flange is made integrally with the store mount flange and is not coplanar therewith. The display flange includes plural openings for receiving respective ring clamps therethrough. A clamp flange bears plural ring clamps and is movably disposed between the store mount flange and display flange for movement between a first configuration, wherein respective ends of the ring clamps are distanced from the display flange such that a substrate formed with holes registered with the ring clamps can be engaged with the ring clamps, and a second configuration, wherein the ends of the ring clamps are closely juxtaposed with the display flange such that substrates engaged with the ring clamps are trapped from being disengaged from the ring clamps.

The ends of the ring clamps may extend at least to the display flange in the second configuration. Indeed, the ends of the ring clamps may extend through the display flange in the second configuration.

In some implementations the store mount flange is formed with plural holes for facilitating engagement of the store mount flange with a variety of store mounts. The substrates can bear information pertaining to a consumer electronic device that is engageable with a fastener extending from the store mount through the store mount flange. The store mount flange is thus disposed between the consumer electronic (CE) device and store mount.

In example embodiments the display flange is oriented at an oblique angle relative to the store mount flange such that when the store mount flange is disposed horizontally on the store mount, a substrate lies flat against the display flange in an upward orientation to facilitate a person standing above the apparatus viewing the substrate.

In another aspect, a method includes positioning a first portion of an information display apparatus horizontally over a store shelf, and orienting a second portion of the apparatus obliquely relative to the first portion. The method also includes providing plural information substrates on the second portion such that the substrates face upward when lying flush on the second portion. The substrates can be flipped away from the second portion without disengaging the substrates from the apparatus.

In another aspect, a display assembly includes an in-store information mount apparatus and plural substrates lying flat on the apparatus in an upward orientation to facilitate a person standing above the apparatus viewing a substrate. The apparatus is movable to permit substrates to be engaged and disengaged with the apparatus.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
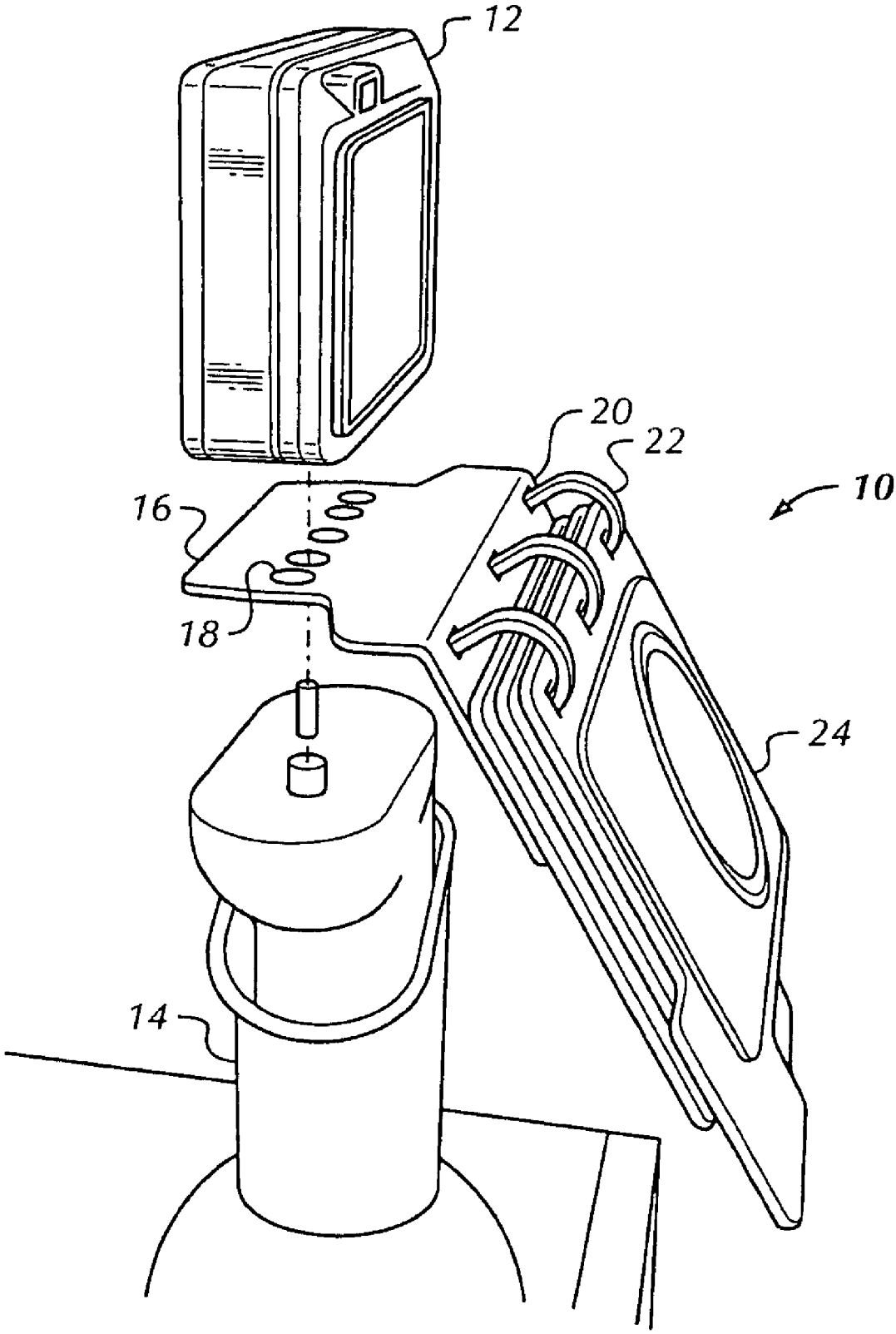
FIG. 1 is an exploded perspective view of the store information mount showing an example camera in an exploded relationship therewith.
Figure 2:
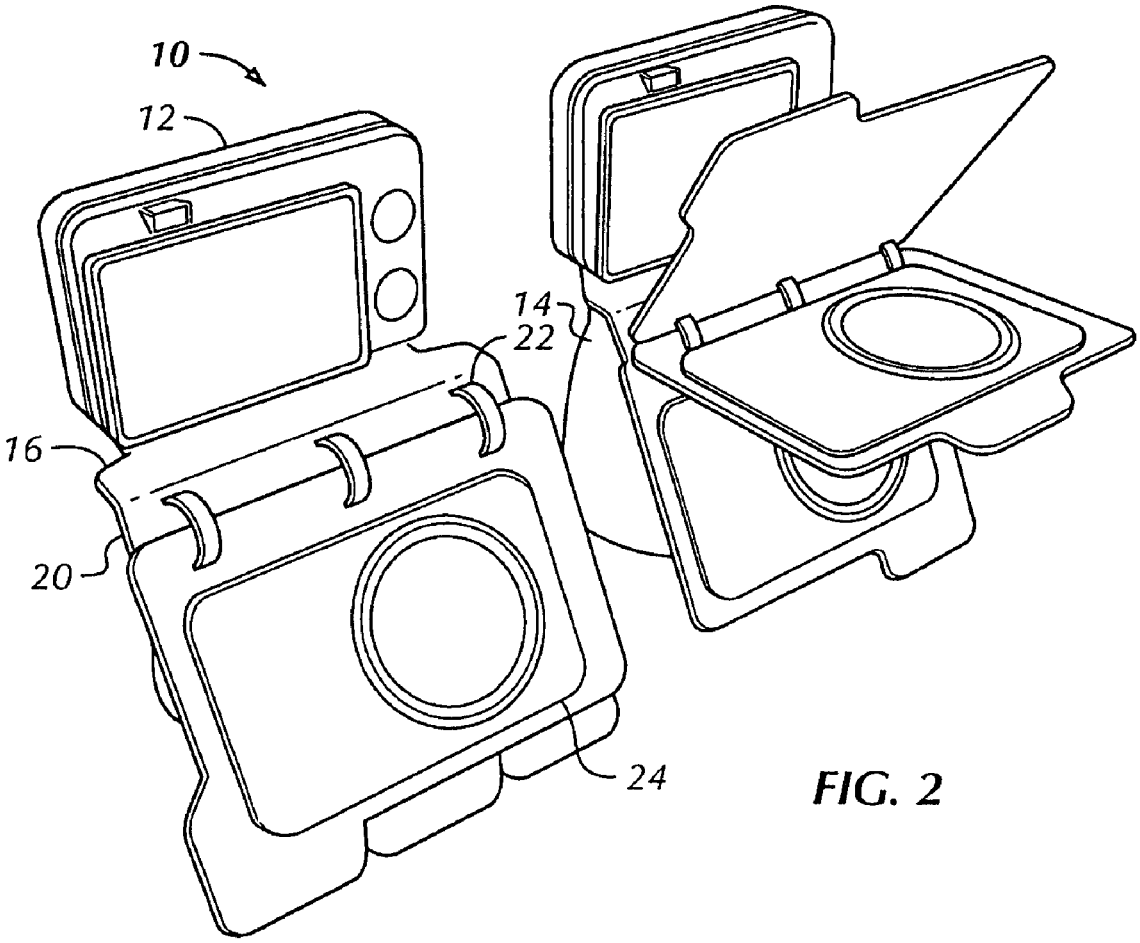
FIG. 2 is a perspective view of a line of store information mounts with substrates in varying degrees of being flipped.

Beginning in cross-reference to FIGS. 1 and 2, a store information mount apparatus 10 is shown. The apparatus 10 is understood to be capable of flippably displaying plural substrates on an in-store display which, in non-limiting embodiments, demonstrate various device colors available as options on a particular consumer electronic device. Furthermore, such substrates are intended lie flat in an upward orientation to facilitate a person standing above the apparatus 10 in viewing a particular substrate.

The apparatus 10 may be associated with a consumer electronic (CE) device 12, which in non-limiting embodiments maybe a digital camera or MP3 player. The device 12 may be supported on the apparatus 10 for display so that a consumer may inspect a particular model of a CE device before purchasing an identical device from the retail store. The CE device 12 is therefore connected to a store shelf mount 14 via the apparatus 10.

Specifically, so that the CE device 12 may connect to the store mount 14, a store mount flange 16 is provided by the apparatus 10. Particularly in reference to FIG. 1, the mount flange 16 is formed with at least one hole 18 so that a fastener (discussed further below) can extend through the hole 18 into the store mount 14 in order to facilitate engagement between the mount 14 and mount flange 16. Furthermore, it is to be understood that the mount flange 16 may alternatively be formed with plural holes for facilitating engagement of the mount flange 16 with a variety of store mounts. The fastener may extend downwardly from the CE device 12 and may be engaged therewith to connect the CE device with the store mount 14.

Still continuing in cross reference to both FIGS. 1 and 2, a display flange 20 preferably is made integrally with the mount flange 16 so that the apparatus 10 may display plural substrates 24 bearing information pertaining to the CE device 12, such as various device colors, which are available for a particular CE device and which can lie flush against the display flange 20. Further, it is to be understood that, in non-limiting embodiments, the integrated display flange 20 may not be coplanar with the mount flange 16, and more particularly may be oriented obliquely to the mount flange 16 as shown. With this combination of structure and as can be appreciated in FIGS. 1 and 2, when the store mount flange 16 is disposed horizontally on the store mount 14, a substrate 24 lies flat against the display flange 20 in an upward orientation to facilitate a person standing above the apparatus viewing the substrate.

The display flange 20 may have plural openings, which will be described in greater detail in FIGS. 3 and 4, which may receive respective ring clamps 22 therethrough. A particular, non-limiting configuration of the ring clamps 22 which are received by the display flange 20 will be described in more detail in FIG. 3.

The ring clamps 22 are capable of receiving and engaging plural substrates 24 that have holes formed in them and registered with the clamps 22. To reiterate, the substrates 24 bear information pertaining to a particular CE device 12 on display, where the CE device 12 is engaged with a fastener extending from the store mount 14 through at least one hole 18 in the mount flange 16. In non-limiting embodiments, the substrates 24 include information relating to various CE device appearances, such as a particular device color, which are available for purchase on the CE device 12. It is to be further understood that the substrates 24 are trapped from being disengaged from the ring clamps 22 in FIGS. 1 and 2.

Figure 3:
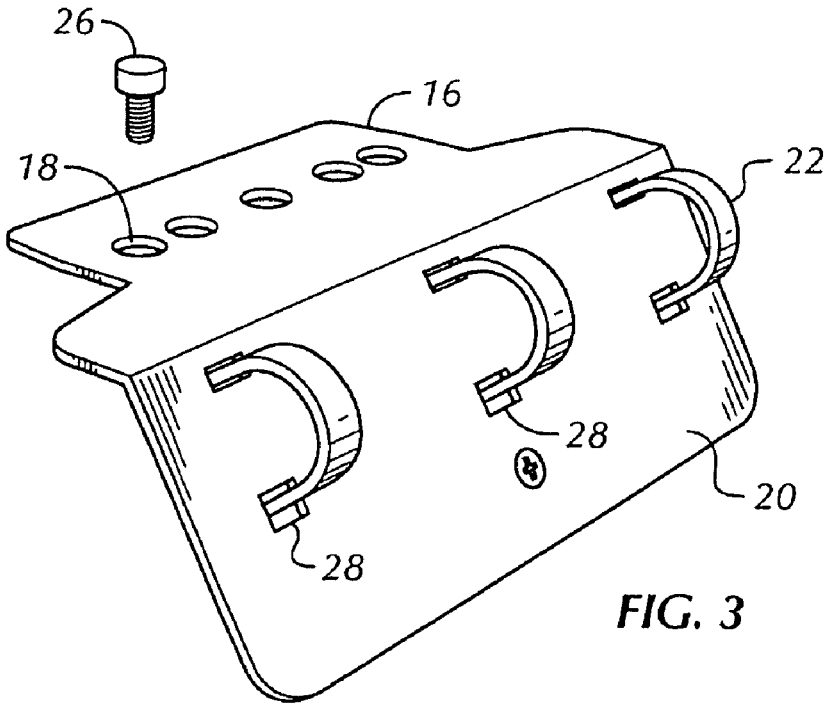
FIG. 3 is a perspective view of a store information mount in the closed configuration, with the substrates removed for clarity.
Figure 4:
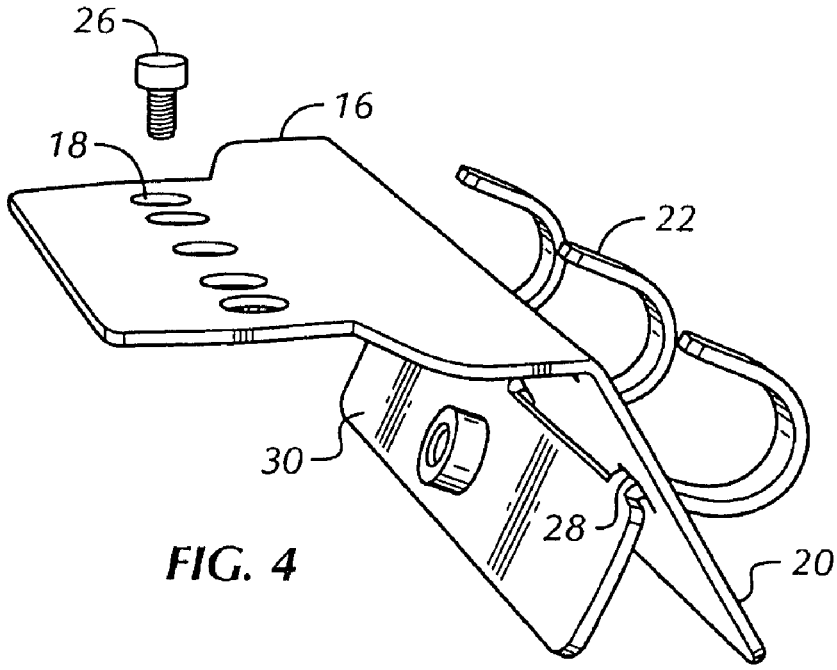
FIG. 4 is a perspective view of the store information mount in the open configuration, with the substrates removed for clarity.

Now in cross-reference to FIGS. 3 and 4, a portion of a store information mount apparatus is shown, particularly with attention to two non-limiting configurations of plural ring clamps on a display flange. As seen in both FIGS. 3 and 4, a fastener 26 can extend through the hole 18 of the mount flange 16 that is registered with a corresponding receptacle in the store mount 14. Also, plural openings 28 are formed in the display flange 20 for receiving the respective ring clamps 22 therethrough. The ring clamps 22 are capable of engaging substrates to be flippably displayed on the store information mount apparatus 10.

In the embodiment shown in FIGS. 3 and 4, the ring clamps 22 are formed integrally with or attached to a clamp flange 30, best shown in FIG. 4. The clamp flange 30 is pivotably disposed in the oblique angle formed between the display flange 20 and mount flange 16 as shown.

In other words, for substrates to be added or removed from the store information mount apparatus, the clamp flange 30 is movably disposed between the mount flange 16 and display flange 20 to allow movement between an open and closed configuration. Specifically, the closed configuration shown in FIG. 3 traps substrates engaged with the ring clamps 22 from being disengaged from the ring clamps 12. Conversely, the open configuration shown in FIG. 4 allows substrates to be engaged with and disengaged from the ring clamps 22.

With respect to the closed configuration shown in FIG. 3, it may be seen that the respective ends of the ring clamps 22 are closely juxtaposed with and preferably touch the display flange 20. Furthermore, the closely juxtaposed ring clamps 22 as shown in FIG. 3, may extend through the display flange 20.

Figure 5:
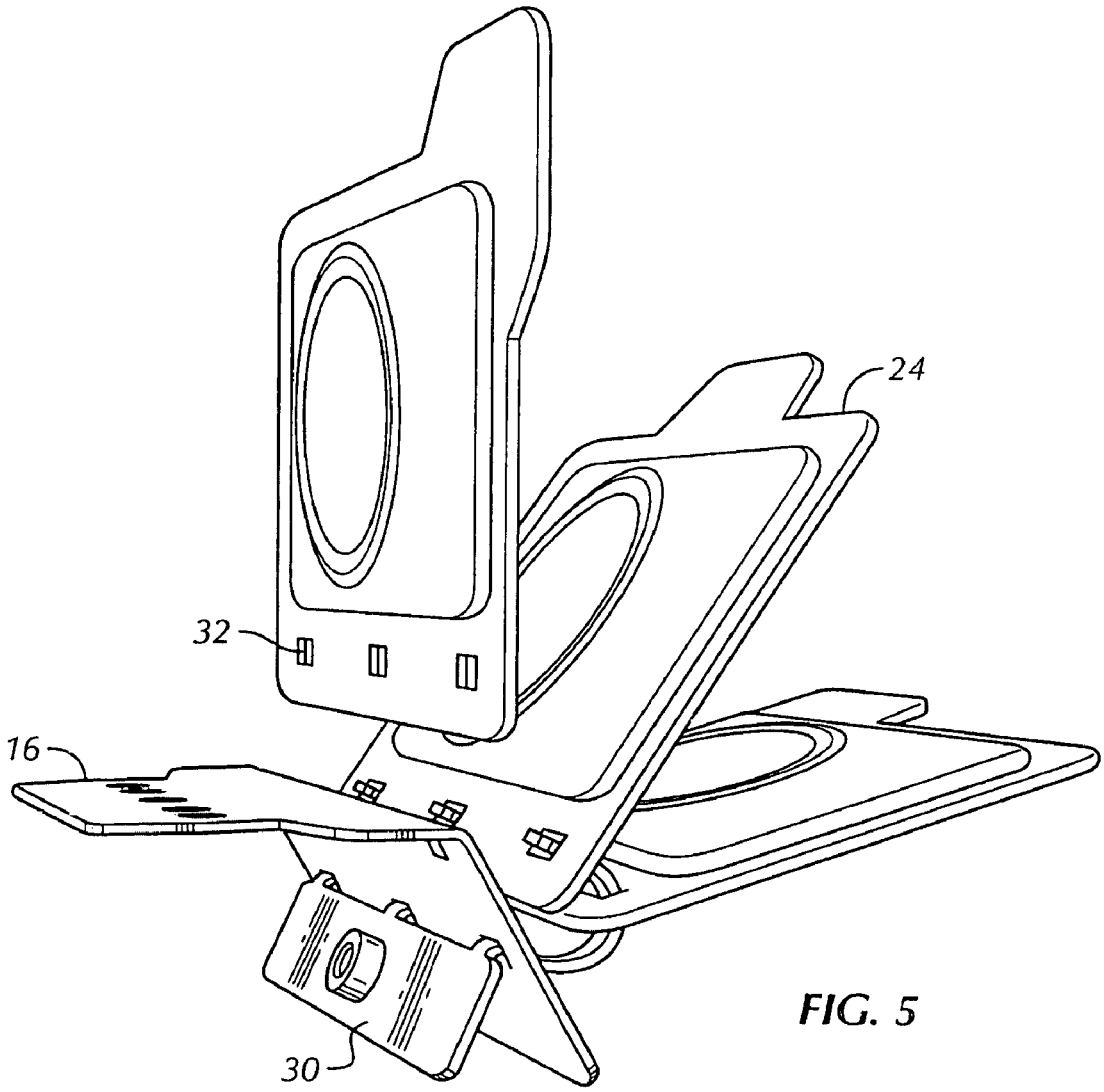
FIG. 5 is a perspective view of the store information mount with one of the substrates in an exploded relationship therewith.

Now with respect to the configuration shown in FIG. 4, it may be appreciated that the respective ends of the ring clamps 22 are distanced from the display flange 20. This allows plural information-bearing substrates 24 formed with holes 32 that are registered with the ring clamps 22 to be engaged with the ring clamps 22 as shown in FIG. 5. Then when appropriate substrates 24 are engaged with the ring clamps 22, the clamp flange 30 with clamps 22 are moved to the closed configuration shown in FIG. 3 so that the substrates are ready for in-store display with the accompanying CE device.

While the particular STORE INFORMATION MOUNT APPARATUS is herein shown and described in detail, it is to be understood that the subject matter which is encompassed by the present invention is limited only by the claims.

What is claimed is:

1. A store information mount apparatus for flippably displaying plural substrates, comprising:

store mount flange formed with at least one hole so that a fastener can extend through the hole and into a store mount to engage the store mount flange with the store mount;

display flange made integrally with the store mount flange and not being coplanar therewith, the display flange including plural openings for receiving respective ring clamps therethrough; and clamp flange bearing plural ring clamps and movably disposed between the store mount flange and display flange for movement between a first configuration, wherein respective ends of the ring clamps are distanced from the display flange such that a substrate formed with holes registered with the ring clamps can be engaged with the ring clamps, and a second configuration, wherein the ends of the ring clamps are closely juxtaposed with the display flange such that substrates engaged with the ring clamps are trapped from being disengaged from the ring clamps.

2. Apparatus of claim 1, wherein the ends of the ring clamps extend at least to the display flange in the second configuration.

3. Apparatus of claim 2, wherein the ends of the ring clamps extend through the display flange in the second configuration.

4. Apparatus of claim 1, wherein the store mount flange is formed with plural holes for facilitating engagement of the store mount flange with a variety of store mounts.

5. Apparatus of claim 1, comprising the substrates, wherein the substrates bear information pertaining to a consumer electronic device engageable with a fastener extending from the store mount through the store mount flange, the store mount flange being disposed between the consumer electronic (CE) device and store mount.

6. Apparatus of claim 5, wherein the substrates are differently colored than each other.

7. Apparatus of claim 6, wherein the CE device is a camera.

8. The apparatus of claim 1, wherein the display flange is oriented at an oblique angle relative to the store mount flange such that when the store mount flange is disposed horizontally on the store mount, a substrate lies flat against the display flange in an upward orientation to facilitate a person standing above the apparatus viewing the substrate.

9. A method comprising:

positioning a first portion of an information display apparatus horizontally over a store shelf;

orienting a second portion of the apparatus obliquely relative to the first portion;

providing plural information substrates on the second portion such that the substrates face upward when lying flush on the second portion; and permitting at least some of the substrates to be flipped away from the second portion without disengaging the substrates from the apparatus, wherein the first portion is established by a store mount flange formed with at least one hole so that a fastener can extend through the hole and into a store mount to engage the store mount flange with the store mount wherein the second portion is established by a display flange including plural openings for receiving respective ring clamps therethrough.

10. The method of claim 9, wherein a clamp flange bearing plural ring clamps is movably disposed between the store mount flange and display flange for movement between a first configuration, wherein respective ends of the ring clamps are distanced from the display flange such that a substrate formed with holes registered with the ring clamps can be engaged with the ring clamps, and a second configuration, wherein the ends of the ring clamps are closely juxtaposed with the display flange such that substrates engaged with the ring clamps are trapped from being disengaged from the ring clamps.

11. The method of claim 10, comprising instructing a person to move the apparatus between the first and second configurations.

12. The method of claim 10, comprising positioning a CE device on the store mount flange.

13. Display assembly comprising:

an in-store information mount apparatus;

plural substrates lying flat on the apparatus in an upward orientation to facilitate a person standing above the apparatus viewing a substrate, the apparatus being movable to permit substrates to be engaged and disengaged with the apparatus;

store mount flange formed with at least one hole so that a fastener can extend through the hole and into a store mount to engage the store mount flange with the store mount;

display flange made integrally with the store mount flange and not being coplanar therewith, the display flange including plural openings for receiving respective ring clamps therethrough; and clamp flange bearing plural ring clamps and movably disposed between the store mount flange and display flange for movement between a first configuration, wherein respective ends of the ring clamps are distanced from the display flange such that a substrate formed with holes registered with the ring clamps can be engaged with the ring clamps, and a second configuration, wherein the ends of the ring clamps are closely juxtaposed with the display flange such that substrates engaged with the ring clamps are trapped from being disengaged from the ring clamps.

14. Assembly of claim 13, wherein the ends of the ring clamps extend at least to the display flange in the second configuration.

15. Assembly of claim 13, wherein the store mount flange is formed with plural holes for facilitating engagement of the store mount flange with a variety of store mounts.

16. Assembly of claim 13, comprising the substrates, wherein the substrates bear information pertaining to a consumer electronic device engageable with a fastener extending from the store mount through the store mount flange, the store mount flange being disposed between the consumer electronic (CE) device and store mount.

17. Assembly of claim 13, wherein the display flange is oriented at an oblique angle relative to the store mount flange such that when the store mount flange is disposed horizontally on the store mount, a substrate lies flat against the display flange in an upward orientation to facilitate a person standing above the apparatus viewing the substrate.

* * * * *